US007000881B2

(12) United States Patent
Fell

(10) Patent No.: US 7,000,881 B2
(45) **Date of Patent: *Feb. 21, 2006**

(54) METHOD AND DEVICE FOR MERCHANDISING A PRODUCT

(76) Inventor: Michael J. Fell, 541 Ramblewood Dr., Bryn Mawr, PA (US) 19010

( * ) Notice: Subject to any disclaimer, the term of this patent is extended or adjusted under 35 U.S.C. 154(b) by 0 days.

This patent is subject to a terminal disclaimer.

(21) Appl. No.: 10/973,202

(22) Filed: Oct. 26, 2004

(65) Prior Publication Data

US 2005/0072892 A1 Apr. 7, 2005

Related U.S. Application Data

(63) Continuation of application No. 09/989,636, filed on Nov. 20, 2001, now Pat. No. 6,808,152, which is a continuation-in-part of application No. 09/459,758, filed on Dec. 13, 1999, now Pat. No. 6,412,743.

(51) Int. Cl.
*A47B 97/04* (2006.01)

(52) U.S. Cl. ..... 248/441.1; 248/346.03

(58) Field of Classification Search ..... 248/441.1, 248/346.03; 211/133.1, 133.3, 153; 40/606.03, 40/611.01, 611.06, 606.18
See application file for complete search history.

(56) References Cited

U.S. PATENT DOCUMENTS

| | | | | |
|---|---|---|---|---|
| 1,152,461 | A | 9/1915 | Wright | 248/473 |
| 1,829,360 | A | 10/1931 | Lambert | 248/473 |
| 2,236,888 | A | 4/1941 | Bishop | 40/152.1 |
| 3,237,330 | A | 3/1966 | Dinstbir | 40/129 |
| 3,640,389 | A | 2/1972 | Snyder | 108/108 |
| 3,984,931 | A | 10/1976 | Belokin, Jr. | 40/130 C |
| 4,075,775 | A | 2/1978 | Shorette | 40/553 |
| 4,125,243 | A | 11/1978 | Liptak | 248/473 |
| 4,136,474 | A | 1/1979 | Belokin, Jr. | 40/559 |
| 4,229,913 | A | 10/1980 | Corrigan | 52/38 |
| 4,290,218 | A | 9/1981 | Drueck, Jr. | 40/553 |
| 4,403,554 | A | 9/1983 | Valentine et al. | 108/180 |
| 4,528,764 | A | 7/1985 | Cobb | 40/553 |
| 4,564,165 | A | 1/1986 | Grant et al. | 248/343 |
| 4,611,717 | A | 9/1986 | Hutson | 211/34 |
| 4,658,526 | A | 4/1987 | Glasener | 40/602 |
| 4,716,671 | A | 1/1988 | Gross | 40/558 |
| 4,856,216 | A | 8/1989 | Gross | 40/559 |
| 4,947,570 | A | 8/1990 | May et al. | 40/553 |
| 5,088,680 | A | 2/1992 | Farmer | 248/158 |
| D330,473 | S | 10/1992 | Lemire | D6/466 |
| 5,208,585 | A | 5/1993 | Sprague | 340/908 |
| 5,282,331 | A | 2/1994 | Fell | 40/617 |
| 5,292,015 | A | 3/1994 | Bumbera | 211/133.1 |
| 5,390,437 | A | 2/1995 | Pearson | 40/661 |
| 5,405,019 | A | 4/1995 | Cross | 211/42 |
| 5,438,938 | A | 8/1995 | Meeker et al. | 108/127 |
| 5,537,767 | A | 7/1996 | Schneider et al. | 40/606 |
| 5,855,351 | A | 1/1999 | Cziraky et al. | 248/45 |
| 5,860,386 | A | 1/1999 | Schwab et al. | 116/63 P |
| 5,878,518 | A | 3/1999 | Grewe | 248/910 |
| 5,881,892 | A | 3/1999 | Loo | 211/126.13 |
| RE36,676 | E | 5/2000 | Sourlis | 52/169.5 |
| 6,412,743 | B1 | 7/2002 | Fell | 248/346.03 |
| 6,808,152 | B1 * | 10/2004 | Fell | 248/441.1 |

* cited by examiner

*Primary Examiner*—Robert P. Olszewski
*Assistant Examiner*—A. Joseph Wujciak
(74) *Attorney, Agent, or Firm*—Volpe and Koenig, P.C.

(57) ABSTRACT

An apparatus for merchandising a product. A first merchandising element is detachably engaged with the apparatus. A second merchandising element is detachably engaged to the apparatus. The first and second merchandising elements are coordinated to market the desired product.

20 Claims, 6 Drawing Sheets

METHOD AND DEVICE FOR MERCHANDISING A PRODUCT

CROSS REFERENCE TO RELATED APPLICATION(S)

This application is a continuation of U.S. patent application Ser. No. 09/989,636, filed Nov. 20, 2001 now U.S. Pat. No. 6,808,152, entitled "Method and Device for Merchandising a Product", which is a continuation-in-part of U.S. patent application Ser. No. 09/459,758, filed Dec. 13, 1999 now U.S. Pat. No. 6,412,743, entitled "Signage Support Base"; priority to both of the above-identified applications is claimed and the entire contents of each of the above-identified applications is hereby incorporated by reference herein as if fully set forth.

BACKGROUND

The present invention is related to merchandising devices. More particularly, the invention is directed to a merchandising method and apparatus incorporating coordinated first and second merchandising elements to market a product.

Signs and sign stands are used for a variety of purposes today with virtually all types of businesses. For example, signs and sign stands of various types are used for point of purchase displays inside establishments. Signs and sign stands are also used outdoors to advertise products and services to passing pedestrians or motorists.

It is desirable that point of purchase signs be lightweight and easy to install in the field, especially by persons of limited experience. Since business and product displays may be positioned outside of a restaurant or convenience store, it is desirable that the signs be positionable on both paved and soft surfaces and that the signs are usable during inclement weather. Most of the lightweight signs of the prior art that are not secured to the ground are unable to withstand the force exerted by winds over a major surface of the sign. This leads to signs being blown over and scratched or damaged.

Due to the increasing competition between advertisers, attracting the attention of consumers using a conventional sign has become more difficult. Thus, it is of paramount importance that a sign or other merchandising product be less prone to damage to maintain maximum visual and aesthetic appeal for consumers. Additionally, it is often desirable for merchandising that the product being advertized by the sign be located near the sign location to facilitate impulse buying by a consumer.

Clearly, there is a need for a method and apparatus for merchandising a product that is easy to install, which can be positioned on any type of surface, which is able to withstand inclement weather and high winds, if used outdoors, and which can present a product to the consumer while maximizing the merchandising effect of the display by using a coordinated merchandising approach to marketing the product.

SUMMARY

Briefly stated, one embodiment of the present invention is directed to a method of merchandising a product. The method includes: providing a base having a top portion and a lateral side; detachably engaging a first merchandising element to the lateral side of the base; attaching a shelving element to the base, the shelving element being adapted to support the product above the base; detachably engaging a second merchandising element to one of the base and the shelving element such that at least a portion of the second merchandising element is disposed generally over the shelving element; and coordinating the first and second merchandising elements to market the product.

The present invention is also directed to an alternative method of merchandising a product. The method includes: positioning a base on a supporting surface, the base having a top portion and a side portion; detachably engaging a merchandising element with the base; and detachably engaging a flexible merchandising element with the top portion of the base by sliding one end of the flexible merchandising element into the base through the top portion thereof, the flexible merchandising element being bendable in response to forces exerted in the direction generally normal to the flexible merchandising element to facilitate the stable positioning of the base, wherein the first and second merchandising elements are coordinated to market the product.

The present invention is also directed to an apparatus for merchandising a product including a base having a top portion and a lateral side. A first merchandising element is detachably engaged with the lateral side. A shelving element is disposed on the base and is adapted to support the product above the base. A second merchandising element detachably engages one of the base and the shelving element such that at least a portion of the second merchandising element is positioned on the side of the shelving element opposite from the base.

The present invention is also directed to an apparatus for merchandising a product including a base having a top portion and a lateral side. A first merchandising element is detachably engaged with the lateral side. A product supporting element is disposed on the base and is adapted to support the product above the base.

BRIEF DESCRIPTION OF THE DRAWING(S)

The foregoing summary, as well as the following detailed description of the preferred embodiments of the invention will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE PREFERRED EMBODIMENT(S)

Figure 1:
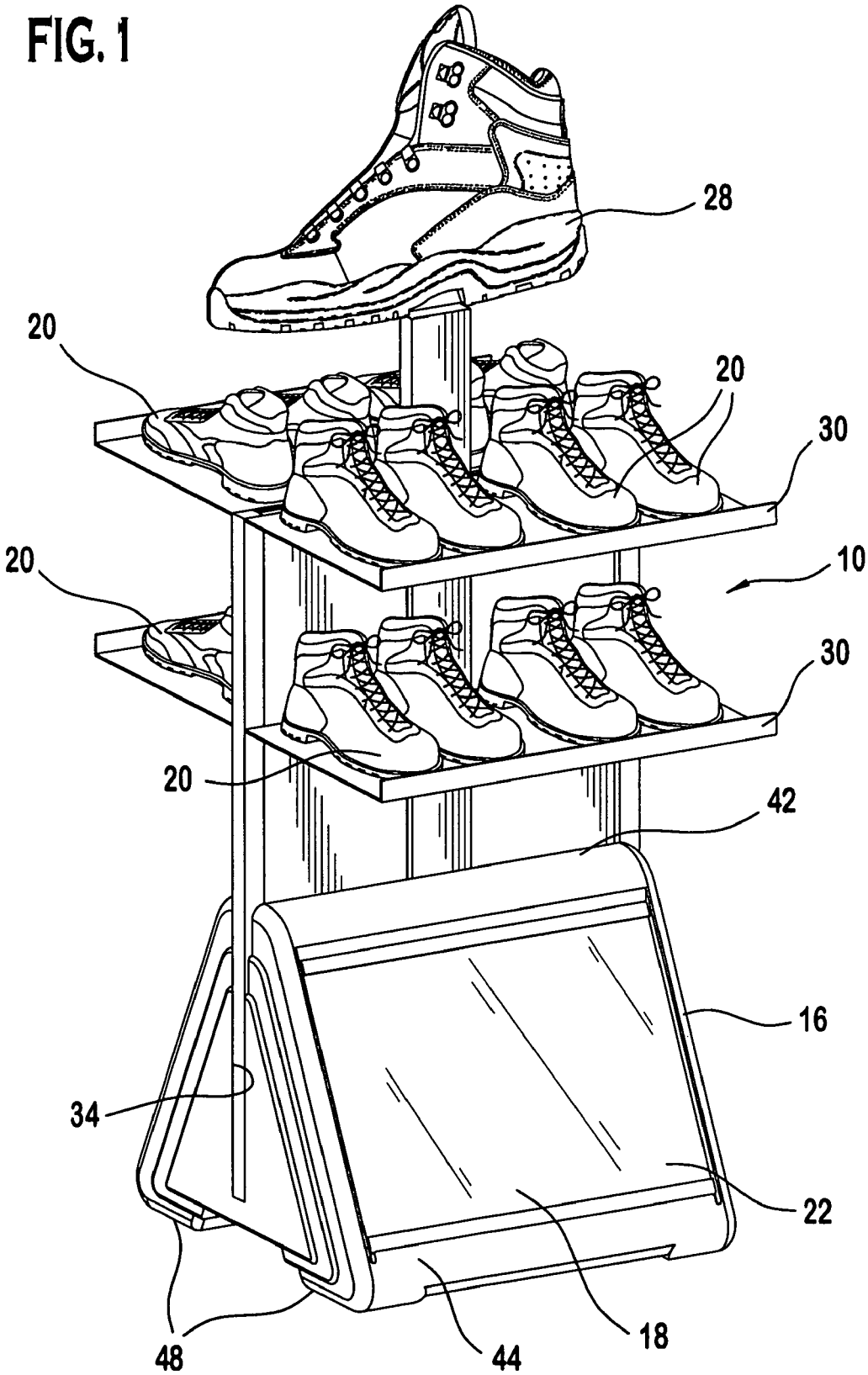
FIG. 1 is a perspective view of a first preferred embodiment of a merchandising apparatus according to the present invention.

Certain terminology is used in the following description for convenience only and is not limiting. The words "top" and "bottom" designate directions in the drawings to which reference is made. The words "inwardly" and "outwardly" refer to directions toward and away from, respectively, the geometric center of the merchandising apparatus and designated parts thereof. The terminology includes the words specifically mentioned above, derivatives thereof, and words of similar import. Additionally, the words "a" and "one" are defined as including one or more of the referenced item unless specifically stated otherwise.

Figure 2:
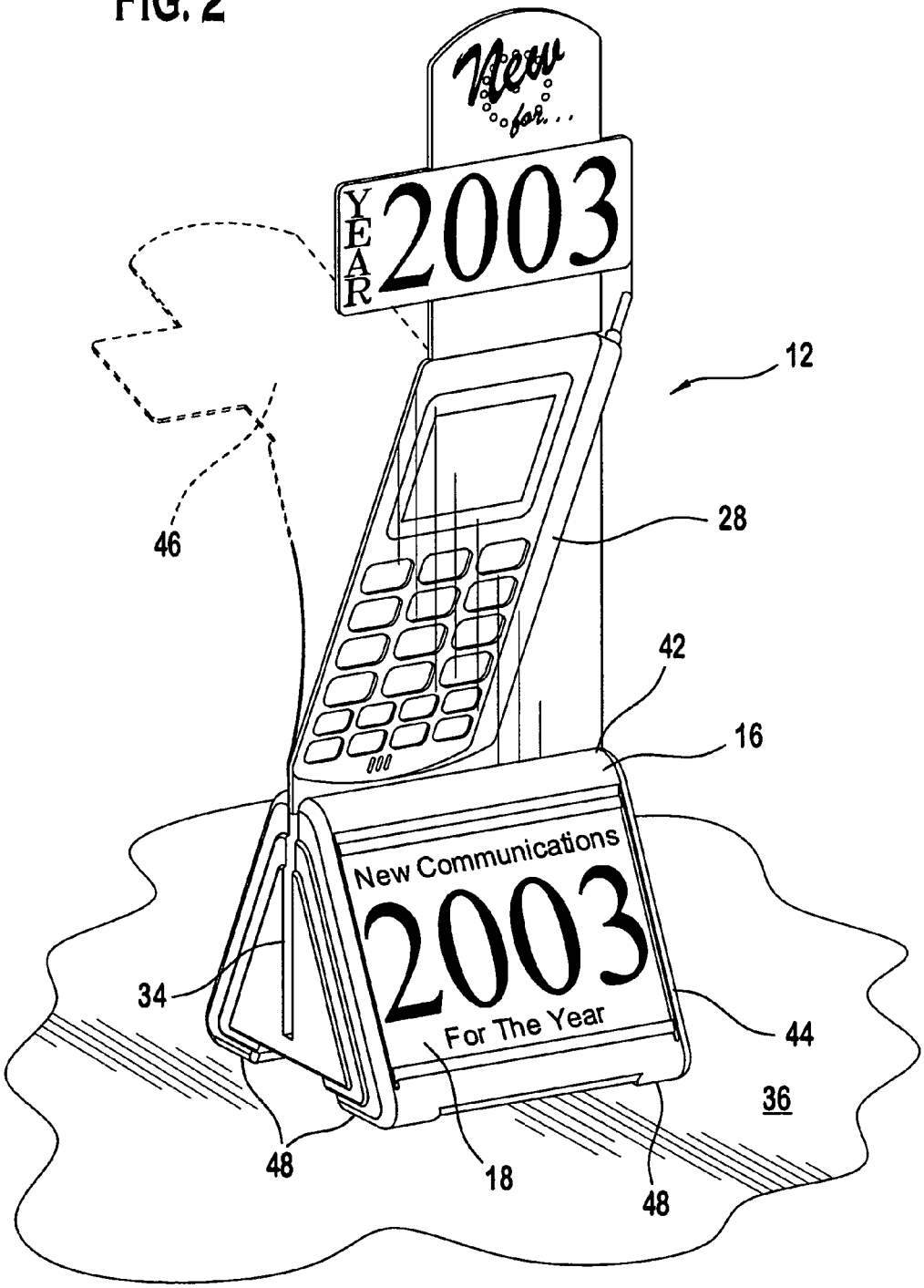
FIG. 2 is a perspective view of a second preferred embodiment of a merchandising apparatus according to the present invention.
Figure 3:
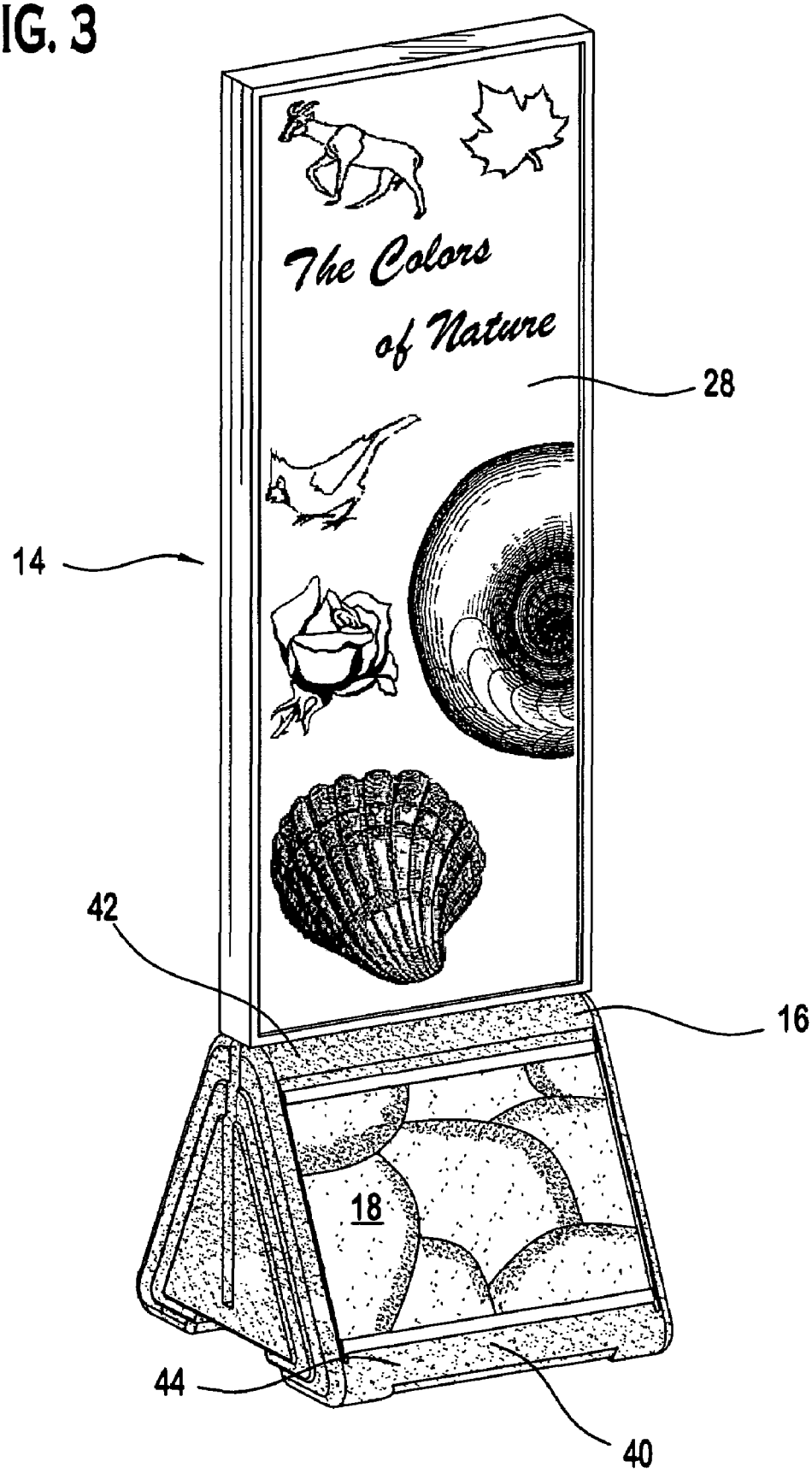
FIG. 3 is a perspective view of a third preferred embodiment of a merchandising apparatus according to the present invention.
Figure 7:
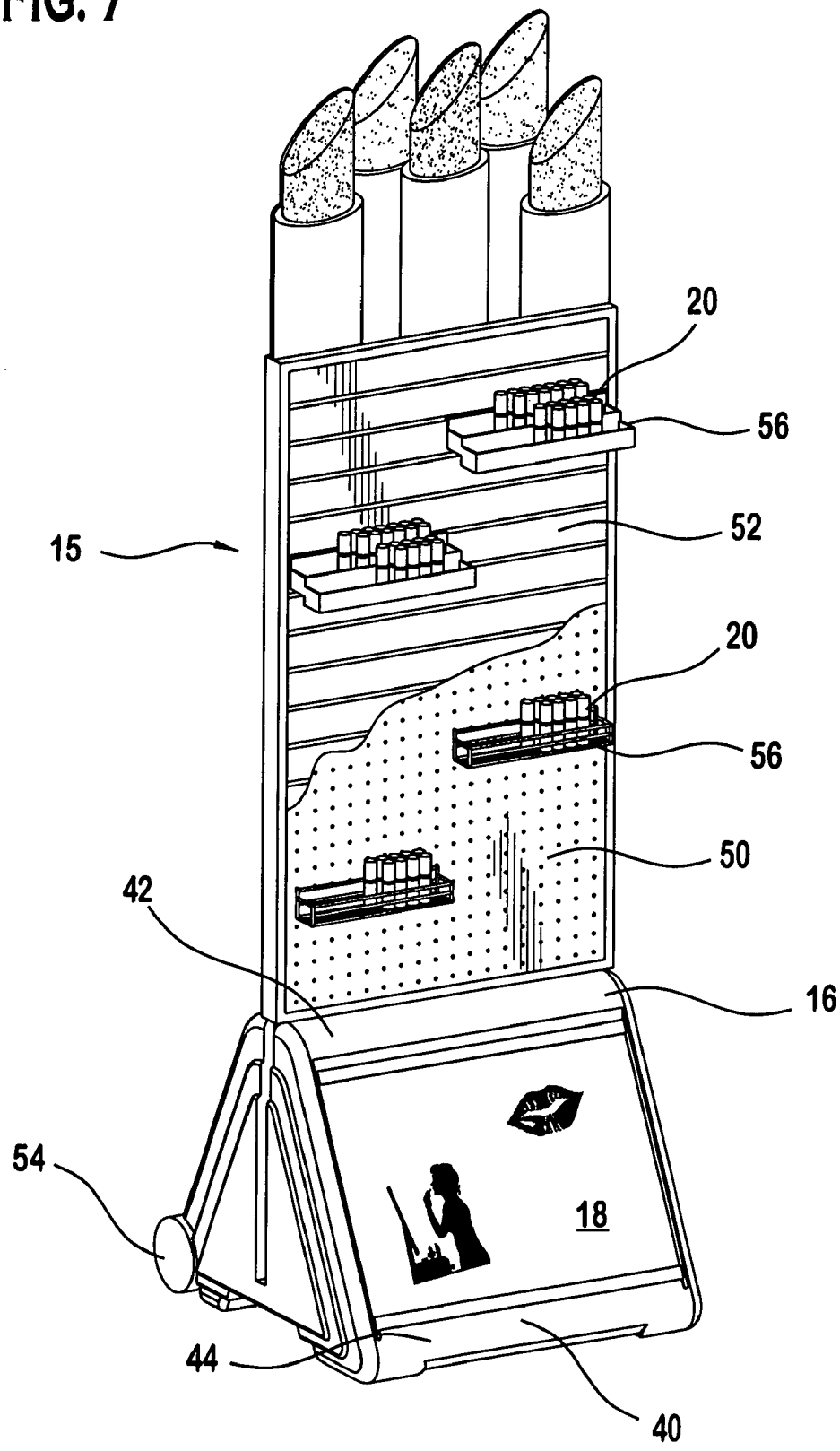
FIG. 7 is a perspective view of a fourth preferred embodiment of the merchandising apparatus according to the present invention.

Referring to the drawings in detail, wherein like numerals indicate like elements throughout, there is shown in FIG. 1, a first preferred embodiment of a merchandising apparatus, generally designated 10. FIG. 2 illustrates a second preferred embodiment of a merchandising apparatus, generally designated 12. FIG. 3 illustrates a third preferred embodiment of a merchandising apparatus, generally designated 14. FIG. 7 illustrates a fourth preferred embodiment of a merchandising apparatus, generally designated 15. Generally speaking, the merchandising apparatuses 10, 12, 14 use coordinated first and second merchandising elements 18, 28 (further described below) to market a product 20, such as golf balls, shoes, compact disks, vacation packages, food products, businesses, sport teams, candies, medicines, or the like. By providing an easy to configure and modify merchandising apparatus 10, 12, 14 having coordinated first and second merchandising elements 18, 28, the present invention allows retailers to effectively market various products to consumers with a minimum amount of time adjusting the merchandising apparatus 10, 12, 14 when changing the product being advertised.

Figure 4:
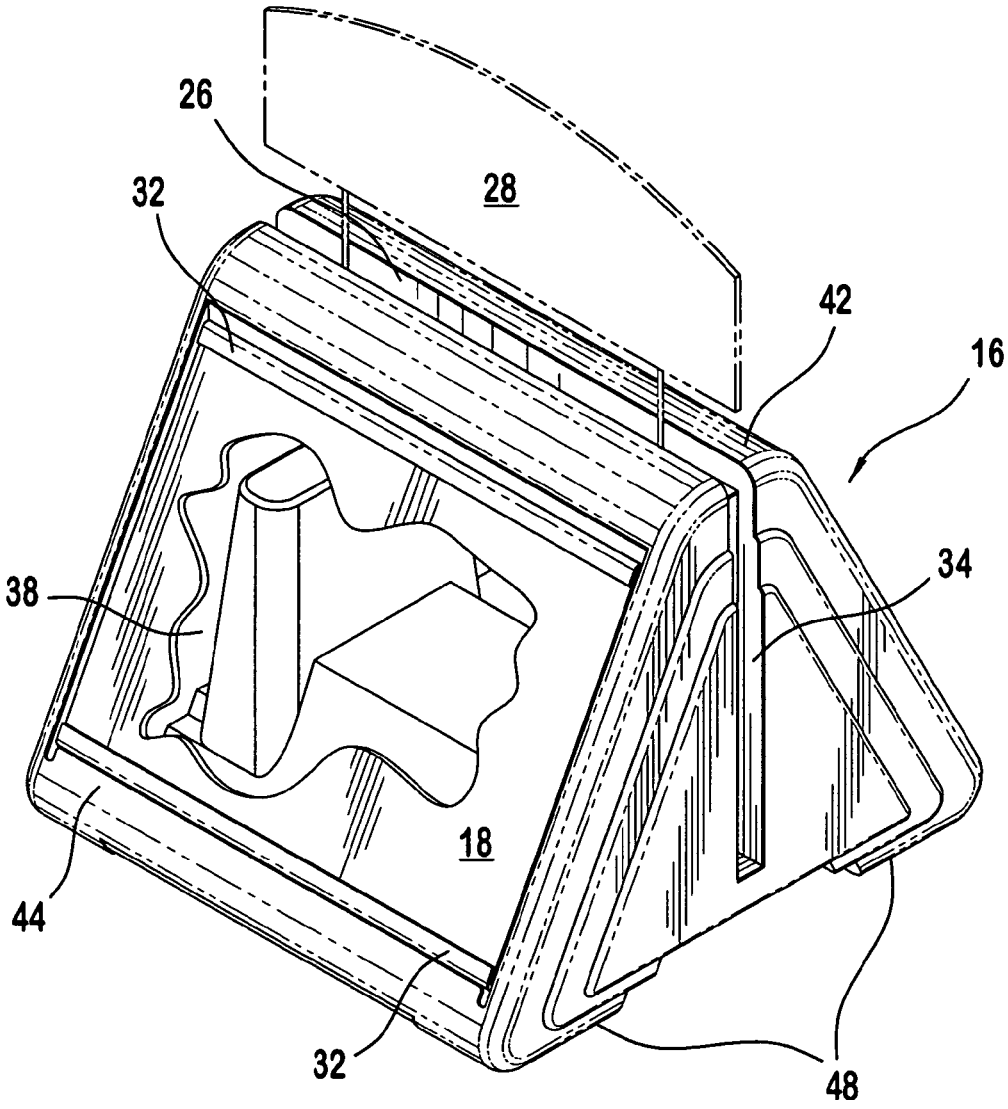
FIG. 4 is a perspective view, partially broken away, of a base usable with any one of the first, second or third preferred embodiments of the merchandising apparatus, illustrating the use of a slidable insert to engage a second merchandising element to the base.
Figure 5:
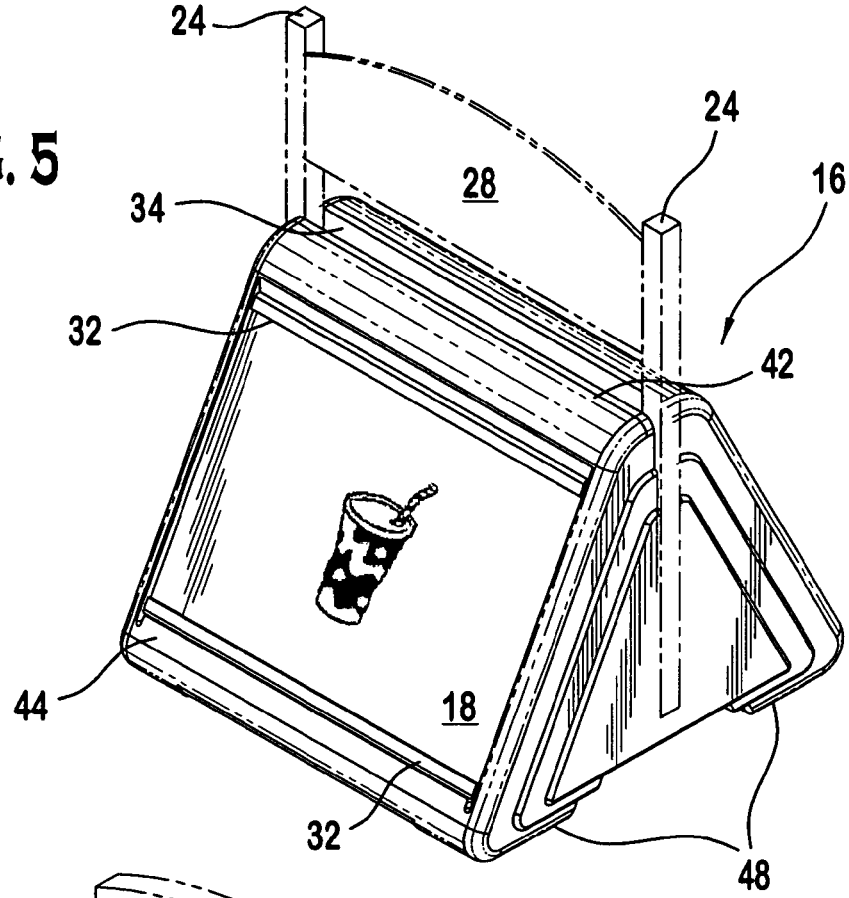
FIG. 5 is a perspective view of the base of FIG. 4 illustrating the use of two posts to connect the second merchandising element to the base.
Figure 6:
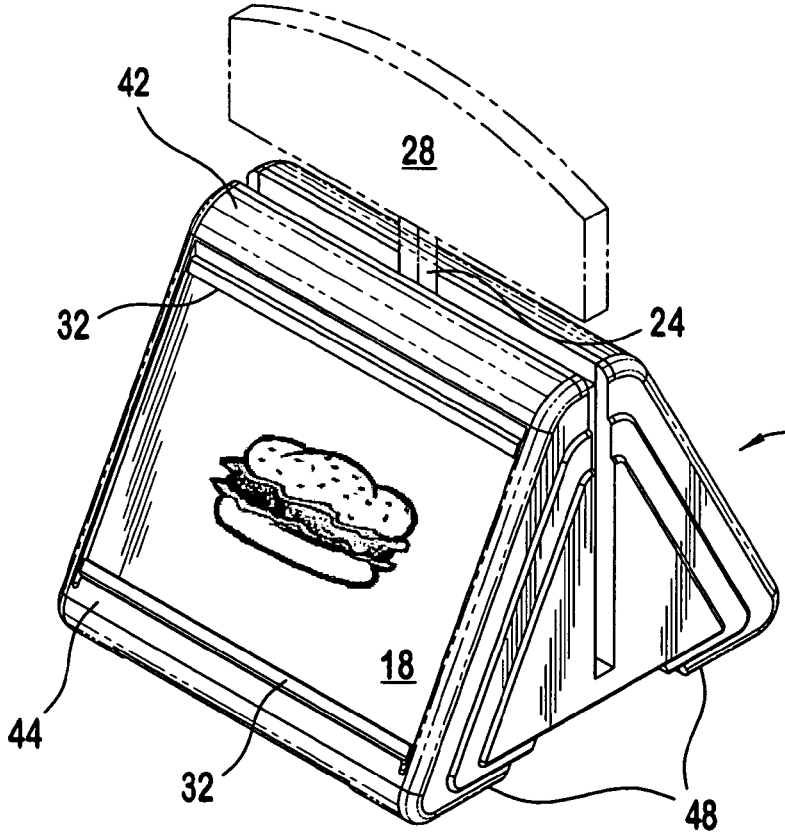
FIG. 6 is a perspective view of the base of FIG. 4 illustrating the use of a single post to connect the second merchandising element to the base.

As shown in FIGS. 1–6, the first through third preferred embodiments of the merchandising apparatus 10, 12, 14 include a base 16 having a top portion 42 and a lateral side, or side portion, 44. As best shown in FIGS. 4–6, the top portion 42 of the base 16 is preferably generally rectangular with a slot 34 located therein. While the slot 34 is shown as extending generally across the entire length of the top portion 42, those skilled in the art will appreciate from this disclosure that the slot 34 can be truncated or discontinuous to form a single passageway or multiple passageways for receiving the second merchandising element 28 (further described below). The second merchandising element 28 can also be attached to the base via a post, or other connector, 24. The post(s) 24 can be integrally formed with the second merchandising element 28 without departing from the scope of the present invention. Alternatively, the second merchandising element 28 can be connected to the base 16 using any other suitable method, such as using fasteners, snap lock connections or the like.

It is preferred, but not necessary, that the lateral ends of the base 16 have a generally trapezoidal shape. The lateral sides 44 of the base 16 are preferably inclined to facilitate the viewability of signs mounted thereon. The base 16 can have a cylindrical shape or any other geometric or irregular shape without departing from the scope of the present invention.

The base 16 is preferably formed from weather resistant, sturdy, high strength material such as a heavy duty polymer. The base 16 can also be formed from wood, steel, aluminum or the like without departing from the present invention. It is preferred, but not necessary, that the base 16 include four feet 48, each located on a bottom surface of the base 16 for contact with a supporting surface 36, such as a grassy surface, an asphalt surface, or a roof of a business establishment.

As shown in FIG. 3, the base 16 can have a textured or colored surface to give the base 16 the appearance of a masonry element. For example, the base 16 can be textured and/or colored to resemble a rock, granite, marble, concrete, brick or the like.

Still with reference to FIGS. 1–6, the merchandising apparatus 10, 12, 14 includes a first merchandising element 18 that is detachably engaged with the lateral side 44 of the base 16. The first merchandising element 18 is preferably any one of a cardboard or polymeric plate, a mirror, a metallic sign or the like. The first merchandising element 18 preferably includes a color, pictorial, overall shape, words, or any other indicia or feature that is directed toward merchandising or marketing the product 20.

The first merchandising element 18 is preferably slidably engaged with guide rails 32 that preferably extend laterally across the top and bottom of the lateral side 44. Alternatively, the merchandising element 18 can be attached to the lateral side 44 using hook and loop material, magnets, releaseable adhesives, suction cups, static charge, fasteners or the like without departing from the scope of the present invention.

The present invention can include a first merchandising element 18 that is translucent. When the first merchandising element 18 is translucent, the first merchandising element 18 can be backlit by a light assembly (not shown) contained within the base 16. The light assembly can be powered by a source external to the merchandising assembly 10, 12, 14 via a power cord (not shown) or the light assembly can be powered by internally mounted batteries (not shown).

While the preferred shape of the first merchandising element 18 is rectangular, those of ordinary skill in the art will appreciate from this disclosure that the first merchandising element 18 can be circularly shaped, triangularly shaped, irregularly shaped or shaped as a facsimile of the product 20 being marketed without departing from the scope of the present invention. Additionally, when the first merchandising element 18 is supported via a magnet(s), multiple such merchandising elements 18 can be layered one over another to allow for unprecedented speed in shifting between merchandising strategies and/or between products 20 being merchandised.

As mentioned above, the first merchandising element 18 can comprise a particular color or surface finish depending on the product being marketed. Referring to FIG. 1 for example, when merchandising shoes, the first merchandising element 18 is preferably, but not necessarily, a mirror 22 that allows consumers to view the shoes that they are wearing while observing the merchandising apparatus 10, 12, 14, 15. Such a mirror 22 also allows consumers to try on and view the shoe products 20 being merchandised by the merchandising apparatus 10.

The first preferred embodiment of a merchandising apparatus 10 preferably includes at least one shelving element 30 (or product supporting element) disposed above the base 16 and adapted to support the product 20 above the base 16. The shelving element 30 is preferably supported via the slot 34 in the base 16. Alternatively, the shelving element 30 can be fastened directly to a portion of the base 16 to securely position the shelving element 30 above the base 16. Those of ordinary skill in the art will appreciate from this disclosure that the shelving element, or product supporting element, can alternatively be a peg board system or a slat wall system used to support at least one product holding device.

It is preferable that the shelving element 30 include two racks that are spaced apart and spaced from the base 16. The shelving element 30 can extend generally outwardly in at least two directions. It is desirable, but not necessary, that the size of the shelving element 30 allows at least one of the product 20 to be located on the shelving element 30. The preferred shelving element 30 is formed from a wire mesh which reduces the weight of the shelving element 30 while providing high strength and rigidity thereto. The shelving element 30 can also be formed from suitable polymers, metal, thin wood, or the like without departing from the scope of the present invention. The shelving element 30 can be integrated with the second merchandising element 28 without departing from the scope of the present invention.

Referring to FIG. 7, a fourth preferred embodiment of the merchandising apparatus 15 is shown. Instead of shelves, the merchandising apparatus 15 can use either one of the peg board system 50, the slat wall system 52 or the like. It is preferred that at least one product holder 56 is used to support product 20 at one of various locations along the peg board system 50 or the slat wall system 52. While both the peg board system 50 and the slat wall system 52 are shown in FIG. 7, it is preferred, but not necessary, that either one or the other be used on a single merchandising apparatus 15.

Referring again to FIGS. 1 through 6, the merchandising apparatus 10, 12, 14 preferably includes the second merchandising element 28 detachably engaged with one of the base 16 and the shelving element 30 such that at least a portion of the second merchandising element 28 is positioned on a side of the shelving element 30 opposite from the base 16. Referring to FIG. 7, the fourth preferred embodiment of the merchandising apparatus 15 can be used with or without the second merchandising element 28 (shown in phantom lines in FIG. 7).

The second merchandising element 28 can be formed by any of the materials and in any of the shapes mentioned above in connection with the first merchandising element 18. Additionally, the first and second merchandising elements 18, 28 can be formed with three dimensional portions (not shown) that may enclose a hollow therein. These three dimensional portions allow portions of the first and second merchandising elements to have raised portions which can form objects, raised lettering or the like.

Referring to FIG. 1, the positioning of the first and second merchandising elements 18, 28 on opposing sides of the shelf supported product 20 allows for the coordinated merchandising of the product 20. It is preferred, but not necessary, that the second merchandising element 28 have a shape corresponding to the product 20 being marketed. For example, when the product 20 being merchandised is shoes, it is preferred that the second merchandising element 28 be shaped in a facsimile of a shoe (in either two or three dimensions) and that the first merchandising element 18 be a mirror 22. It is preferable that at least a portion of the second merchandising element 28 extends behind the shelving element 30 when viewed from in front of the merchandising apparatus 10.

Referring to FIG. 3, the second merchandising element 28 can be an illuminated sign disposed over the top portion 42 of the base 16. The illuminated sign 28 can be powered by a light assembly housed within the base 16 or within the second merchandising element 28 itself. As shown in FIG. 3, it is preferable, but not necessary, that the illuminated second merchandising element 28 be formed as an enclosure capable of housing light emitting elements, such as fluorescent bulbs (not shown). The light emitting elements and/or light assembly can be powered by a power source remote from the merchandising assembly 10, 12, 14, 15 via a power cord (not shown) or can be powered by internal batteries (not shown).

Referring to FIG. 7, wheels 54 can be rotatably mounted to the base 16 to allow an operator to easily move the merchandising apparatus 10, 12, 14, 15 from one location to another. It is preferred that two wheels 54 are positioned proximate to one side of the base 16 to allow an operator to pivot the base 16 about one edge to allow the merchandising apparatus 10, 12, 14, 15 to be rolled to a new location.

A first preferred method of merchandising a product 20 is as follows. Unless otherwise specified, each of the components used with this method is the same as that described above in connection with the first, second, and third preferred merchandising apparatuses 10, 12, 14. Referring to FIG. 1, the first preferred method for merchandising a product 20 includes providing a base 16 having a top portion 42 and a lateral side 44. The first preferred method can, but does not necessarily, include forming the base 16 to have the appearance of a masonry element.

The first preferred method of merchandising a product 20 includes the step of detachably engaging the first merchandising element 18 to the lateral side 44 of the base 16. When the product 20 being merchandised is shoes, it is preferable that the engaging of the first merchandising element includes detachably engaging a mirror 22 to the lateral side 44 of the base 16.

The first preferred method of merchandising the product 20 includes the step of attaching the shelving element 30 to the base to support the product 20 above the base 16. It is preferable, but not necessary, that the shelving element 30 includes shelves which extend in at least two directions.

The first preferred method of merchandising the product 20 includes detachably engaging the second merchandising element 28 to one of the base 16 and the shelving element 30 such that at least a portion of the second merchandising element 28 is positioned generally over the shelving element 30. It is preferable, but not necessary, that the step of engaging a second merchandising element include detachably engaging a sign having a shape that corresponds to the product 20 being marketed. It is also preferable that at least a portion of the second merchandising element 28 extend behind the shelving element 30.

The first preferred method of merchandising the product 20 further includes coordinating the first and second merchandising elements 18, 28 to market the product 20. For example, it is preferable, but not necessary, that the first preferred method of merchandising a product 20 include providing a second merchandising element 28 that is a sign related to a shoe-type product, such as shoes, shoe laces, sole inserts, shoe polish, or the like, and that the first merchandising element 18 is a mirror (or other shoe related item or advertisement). Additionally, the step of engaging the second merchandising element can, but does not necessarily, include detachably engaging an illuminated sign to the base 16.

A second preferred method of merchandising a product 20 is as follows. Unless otherwise mentioned, the steps, materials, and components described above in connection with either the first, second or third preferred embodiments of the merchandising apparatus 10, 12, 14 or the first preferred method can be integrated and used with the second preferred method of merchandising the product 20 without departing from the scope of the second preferred method of merchandising a product 20.

The second preferred method of merchandising a product 20 includes positioning the base 16 on the supporting surface 36. The second preferred method can, but does not necessarily, include providing a base 16 with an enclosed hollow area 38 (shown in FIG. 4). When a base 16 containing a hollow area 36 is used with the second preferred method, it is preferable that water, sand or another type of ballast be placed within the hollow area 38 of the base 16 to increase the stability of the base 16.

The second preferred method of merchandising a product 20 includes the step of detachably engaging a merchandising element 18 with the base 16. The second preferred method also includes the step of detachably engaging a flexible merchandising element 28 with the top portion 42 of the base 16 by sliding one end of the flexible merchandising element 28 into the base 16 through the top portion 42 thereof. The merchandising element 18 and the flexible merchandising element 28 can be formed by any of the materials discussed above in connection with the first and second merchandising elements 18, 28.

The flexible merchandising element 28 is bendable is response to forces exerted in a direction generally normal to the flexible merchandising element to facilitate the stable positioning of the base 16. It should be understood that the forces created by wind along the surface of the flexible merchandising element 28 are considered "forces exerted in the direction generally normal to the flexible merchandising element" as used in the claims. It is preferable, but not necessary, that the flexible merchandising element 28 be capable of bending through an angle of at least thirty-five (35) degrees. Referring to FIG. 2, a bent position 46 of the flexible merchandising element 28 is shown in phantom lines illustrating one bent position when the flexible merchandising element 28 is receiving wind gusts along a surface thereof.

The second preferred method of merchandising a product 20 includes coordinating the merchandising element 18 and the flexible merchandising element 28 to market the product 20. The second preferred method of merchandising a product 20 results in a merchandising apparatus 12 that is well suited for use in outside environments.

It is recognized by those skilled in the art, that changes may be made to the above-described embodiments of this invention without departing from the inventive concept thereof. It is understood, therefore, that this invention is not limited to the particular embodiments disclosed, but is intended to cover all modifications that are within the spirit and scope of the invention as defined by the appended claims.

What is claimed is:

1. A method of merchandising a product, comprising:

providing a base having a top portion and a lateral side wall;

detachably engaging a first merchandising element to the lateral side wall of the base;

detachably engaging a second merchandising element to the base such that at least a portion of the second merchandising element is positioned generally over the top portion of the base, the second merchandising element having a shape corresponding to the product; and coordinating the first and second merchandising elements to market the product.

2. The method of claim 1, wherein the second merchandising element has first and second major surfaces and a plurality of shelves thereon, wherein the shelves extend outwardly from the second merchandising element in opposite directions from the first and second major surfaces.

3. The method of claim 2, further comprising placing at least one of the product on the shelves.

4. The method of claim 1, wherein the step of detachably engaging the first merchandising element comprises detachably engaging a mirror to the lateral side of the base.

5. The method of claim 4, wherein the step of providing the second merchandising element further comprises providing a sign related to a shoe.

6. The method of claim 1, wherein the step of providing the base further comprises forming the base to have a masonry element appearance.

7. The method of claim 1, wherein the step of detachably engaging the second merchandising element comprises detachably engaging an illuminated sign.

8. A method of merchandising a product, comprising:

positioning a base on a supporting surface, the base having a top portion and a side portion;

detachably engaging a merchandising element with the base;

detachably engaging a flexible merchandising element with the top portion of the base by sliding one end of the flexible merchandising element into the base through the top portion thereof, the flexible merchandising element being bendable in response to forces exerted in a direction generally normal to the flexible merchandising element to facilitate the stable positioning of the base, the flexible merchandising element being capable of bending so that a body of the flexible merchandising element extends through an angle, wherein the merchandising element and the flexible merchandising element are coordinated to market the product and the flexible merchandising element includes a shape corresponding to the product.

9. The method of claim 8, wherein the step of providing the base further comprises forming the base to have a masonry element appearance.

10. The method of claim 8, wherein the step of providing the base includes forming the base with an enclosed hollow area.

11. The method of claim 10, further comprising the step of placing ballast within the hollow area of the base to add stability to the base.

12. An apparatus for merchandising a product, comprising:

a base enclosing a defined volume and having a top portion and a lateral side wall;

a first merchandising element detachably engaged with the lateral side wall;

a shelving element disposed above and engaged with the base and adapted to support the product above the base, wherein the shelving element includes a vertical panel that extends generally upwardly from the base and includes first and second major surfaces, wherein the shelving element further includes shelves which extend outwardly therefrom; and a second merchandising element detachably engaged with one of the base and the shelving element such that at least a portion of the second merchandising element is positioned over the shelving element and on a side of the shelving element opposite from the base, wherein the second merchandising element has a shape corresponding to the product.

13. The apparatus of claim 12, wherein at least one of the product is located on the shelving element.

14. The apparatus of claim 12, wherein at least a portion of the second merchandising element extends beyond the shelving element.

15. The apparatus of claim 12, wherein the first merchandising element comprises a mirror.

16. The apparatus of claim 15, wherein the second merchandising element is a sign related to a shoe.

17. The apparatus of claim 12, wherein the base has an appearance of a masonry element.

18. A product merchandising apparatus comprising:

a base that defines a receiving slot generally across a top surface of the base;

a signage retention mechanism that supports a signage associated with the product in a generally upright orientation;

the signage including a generally vertical support that is received within the slot, the signage having a shape corresponding to the product;

at least one product display mechanism attached to the vertical support between the signage and the base; and, a display element disposed on the base that corresponds to a displayed product.

19. The apparatus of claim 18, wherein the display element has the same general shape as the displayed product.

20. The apparatus of claim 18 wherein the vertical support and the display element are a one piece unit.

* * * * *